US009874120B2

(12) United States Patent
Son et al.

(10) Patent No.: US 9,874,120 B2
(45) Date of Patent: Jan. 23, 2018

(54) CONTINUOUS VARIABLE VALVE LIFT APPARATUS AND ENGINE PROVIDED WITH THE SAME

(71) Applicant: Hyundai Motor Company, Seoul (KR)

(72) Inventors: You Sang Son, Whasung-Si (KR); Kyoung Pyo Ha, Whasung-Si (KR); Back Sik Kim, Whasung-Si (KR); Kiyoung Kwon, Whasung-Si (KR)

(73) Assignee: Hyundai Motor Company, Seoul (KR)

( * ) Notice: Subject to any disclaimer, the term of this patent is extended or adjusted under 35 U.S.C. 154(b) by 107 days.

(21) Appl. No.: 14/955,866

(22) Filed: Dec. 1, 2015

(65) Prior Publication Data

US 2017/0081994 A1 Mar. 23, 2017

(30) Foreign Application Priority Data

Sep. 21, 2015 (KR) ..... 10-2015-0133338

(51) Int. Cl.

| | |
|---|---|
| ***F01L 1/34*** | (2006.01) |
| ***F01L 13/00*** | (2006.01) |
| *F01L 1/18* | (2006.01) |
| *F01L 1/24* | (2006.01) |

(52) U.S. Cl.

CPC ..... *F01L 13/0015* (2013.01); *F01L 13/0026* (2013.01); *F01L 1/185* (2013.01); *F01L 1/2405* (2013.01); *F01L 13/0063* (2013.01); *F01L 2013/0084* (2013.01); *F01L 2013/103* (2013.01); *F01L 2105/00* (2013.01)

(58) Field of Classification Search

CPC ..... F01L 13/0026; F01L 1/185; F01L 1/2405; F01L 13/0015; F01L 13/0063

USPC ..... 123/90.16, 90.39, 90.44, 90.6

See application file for complete search history.

(56) References Cited

U.S. PATENT DOCUMENTS 9,574,467 B2 * 2/2017 Ha ..... F01L 13/0015 123/90.16

FOREIGN PATENT DOCUMENTS

| | | | |
|---|---|---|---|
| JP | 11-22433 | A | 1/1999 |
| JP | 5516493 | B2 | 4/2014 |
| JP | 2014-77390 | A | 5/2014 |
| JP | 2015-117692 | A | 6/2015 |
| KR | 10-2010-0047673 | A | 5/2010 |

* cited by examiner

*Primary Examiner* — Ching Chang

(74) *Attorney, Agent, or Firm* — Morgan Lewis & Bockius LLP

(57) ABSTRACT

A continuously variable valve lift apparatus may include a camshaft, a cam portion on which two rotation portions are formed, on which a cam is formed between the two rotation portions and into which the camshaft is inserted, two slider housings into which each rotation portion is rotatably inserted therein, of which a position is moved for changing a relative position of the cam portion with respect to the camshaft and onto which a guide slot is formed, a control portion configured to selectively move the position of each of the two slider housings, a guide shaft parallel to the camshaft and inserted into the guide slot for guiding movement of the slider housing, an output portion rotatable around a pivot shaft and onto which a valve shoe is formed, and a valve device configured to be driven by the valve shoe.

14 Claims, 8 Drawing Sheets

CONTINUOUS VARIABLE VALVE LIFT APPARATUS AND ENGINE PROVIDED WITH THE SAME

CROSS-REFERENCE TO RELATED APPLICATION

The present application claims priority to Korean Patent Application No. 10-2015-0133338 filed Sep. 21, 2015, the entire contents of which as incorporated herein for all purposes by this reference.

BACKGROUND OF THE INVENTION

Field of the Invention

The present invention relates to a continuous variable valve lift apparatus and an engine provided with the same. More particularly, the present invention relates to a continuous variable valve lift apparatus an engine provided with the same which may vary valve lift according to operation conditions of an engine with a simple construction.

Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a continuous variable valve lift apparatus and an engine provided with the same which may vary valve lift according to operation conditions of an engine, with a simple construction.

According to various aspects of the present invention, a continuously variable valve lift apparatus may include a camshaft, a cam portion on which two rotation portions are formed, on which a cam is formed between the two rotation portions and into which the camshaft is inserted, two slider housings into which each rotation portion is rotatably inserted therein, of which a position is moved for changing a relative position of the cam portion with respect to the camshaft and onto which a guide slot is formed, a control portion configured to selectively move the position of each of the two slider housings, a guide shaft parallel to the camshaft and inserted into the guide slot for guiding movement of the slider housing, an output portion rotatable around a pivot shaft and onto which a valve shoe is formed, and a valve device configured to be driven by the valve shoe.

The rotation portions and the cam of the cam portion may be integrally formed.

Two camshaft holes may be formed on the camshaft, and a pin hole may be formed on each rotation portion, in which the continuously variable valve lift apparatus may further include a pin slider rotatably disposed to each pin hole and onto which a slider hole is formed, and a connecting pin connected to each camshaft hole and slidably inserted into the slider hole.

The continuously variable valve lift apparatus may further include a bearing inserted between the slider housing and each rotation portion.

The valve shoe may be formed as a pair, and the valve device may be disposed as a pair and each valve device of the pair may include a swing arm roller contacting each valve shoe.

The continuously variable valve lift apparatus may further include an output roller mounted between the valve shoes and contacting the cam.

The control portion comprises an eccentric shaft connected to the slider housing.

According to various aspects of the present invention, an engine may include a camshaft, a cam portion on which two rotation portions are formed, on which a cam is formed between the two rotation portions and into which the camshaft is inserted, two slider housings into which each rotation portion is rotatably inserted, of which a position is moved for changing a relative position of the cam portion with respect to the camshaft and onto which a guide slot is formed, a control portion configured to selectively move the position of the slider housing, a guide shaft parallel to the camshaft and inserted into the guide slot for guiding movement of the slider housing, an output portion mounted to a cylinder head, rotatable around a pivot shaft and onto which a valve shoe is formed, and a valve device configured to be driven by the valve shoe.

The engine may further include a bearing inserted between the slider housing and each rotation portion.

The engine may further include an output roller mounted between the valve shoes and contacting the cam.

As described above, a continuous variable valve lift apparatus according to various embodiments of the present invention may vary valve lift according to operation conditions of an engine, with a simple construction.

The continuous variable valve lift apparatus according to various embodiments of the present invention may reduce duration in minimum valve lift comparing to general continuous variable valve lift apparatuses.

The continuous variable valve lift apparatus according to various embodiments of the present invention may advance closing timing of an intake valve so that may reduce pumping loss and enhance fuel economy.

The continuous variable valve lift apparatus according to various embodiments of the present invention may be reduced in size and thus the entire height of a valve train may be reduced.

Since the continuous variable valve lift apparatus may be applied to an existing engine without excessive modification, thus productivity may be enhance and production cost may be reduced.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
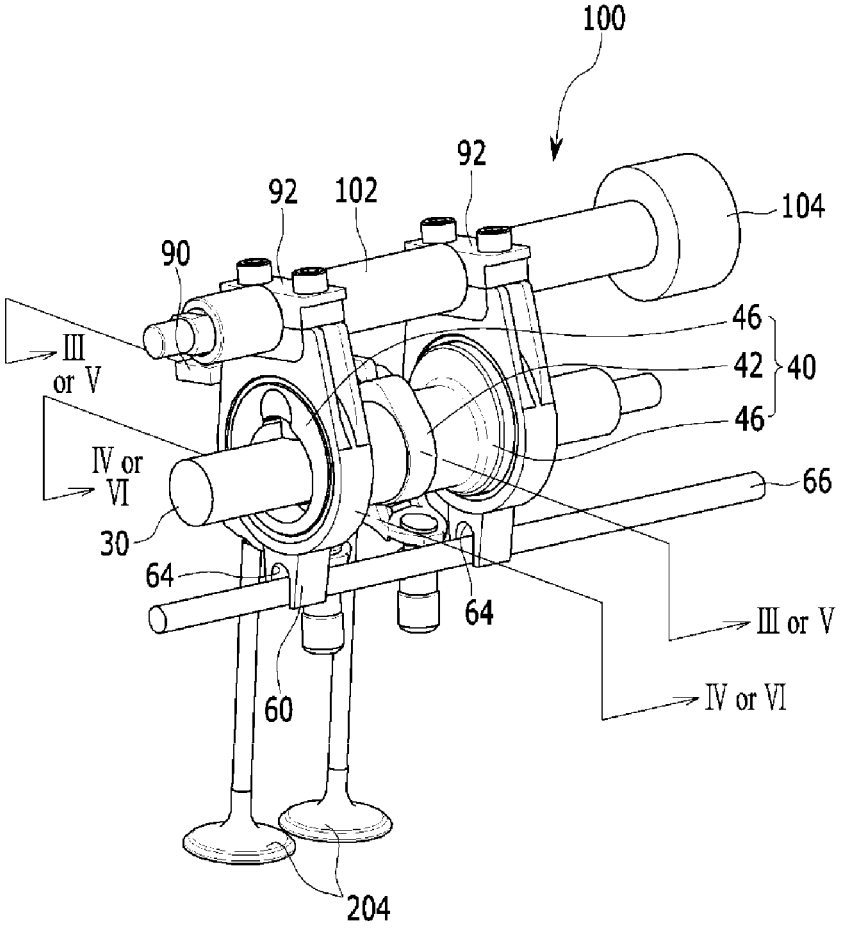
FIG. 1 is a perspective view of an exemplary continuous variable valve lift apparatus according to the present invention.
Figure 2:
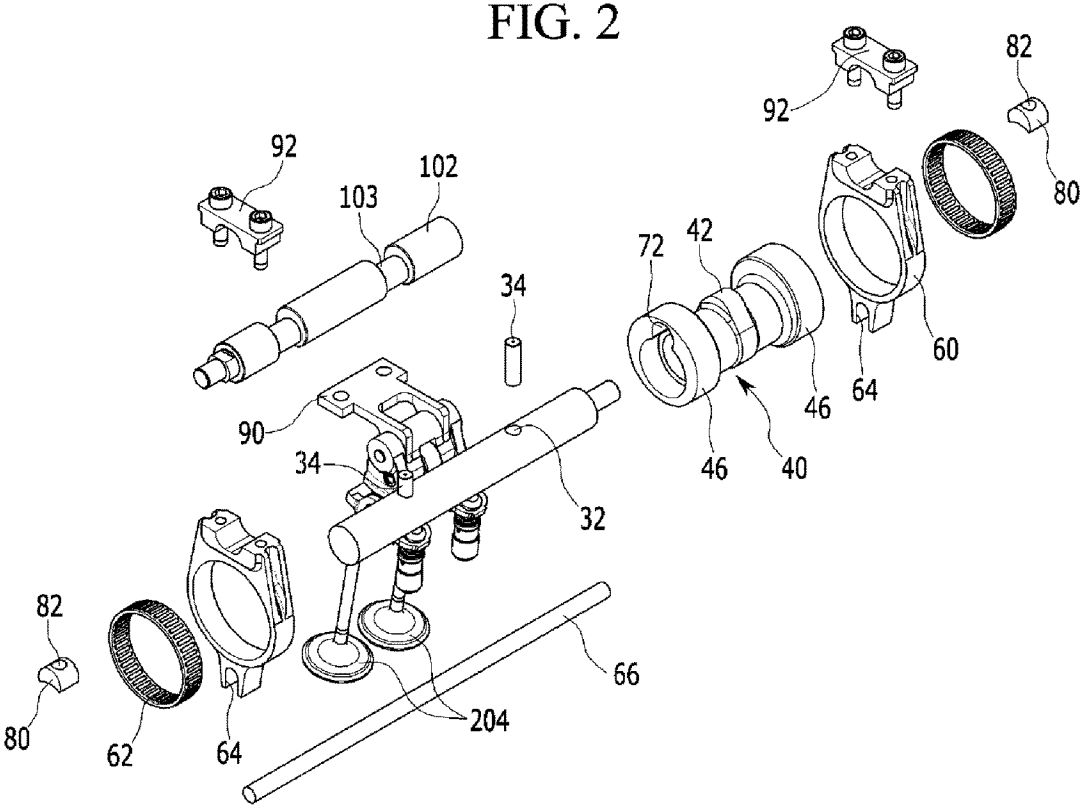
FIG. 2 is an exploded perspective view of the exemplary continuous variable valve lift apparatus according to the present invention.

FIG. 1 is a perspective view of a continuous variable valve lift apparatus according to various embodiments of the present invention and FIG. 2 is an exploded perspective view of a continuous variable valve lift apparatus according to various embodiments of the present invention.

Figure 3:
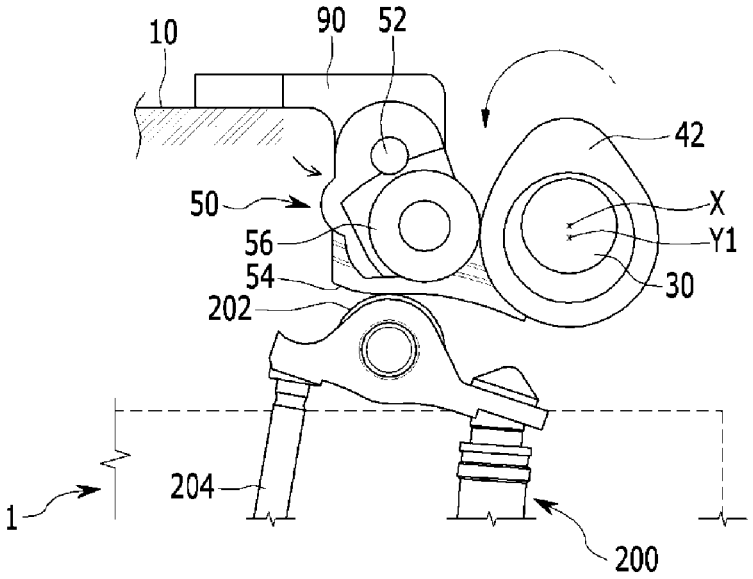
FIG. 3 is a cross-sectional view along line III-III of FIG. 1 describing a continuously variable valve lift apparatus according to an exemplary embodiment of the present invention operated in low lift mode.
Figure 4:
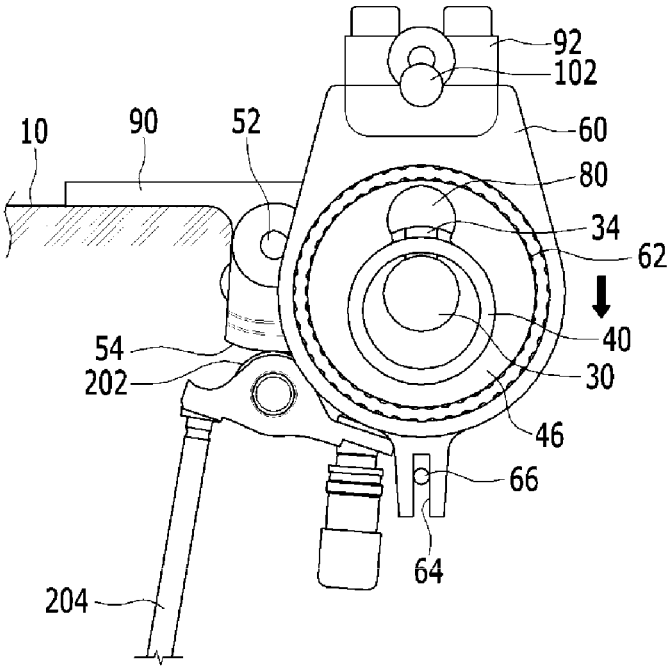
FIG. 4 is a cross-sectional view along line IV-IV of FIG. 1 describing a continuously variable valve lift apparatus according to an exemplary embodiment of the present invention operated in low lift mode.

FIG. 3 is a cross-sectional view along line III-III of FIG. 1 describing a continuously variable valve lift apparatus according to various embodiments of the present invention operated in low lift mode and FIG. 4 is a cross-sectional view along line IV-IV of FIG. 1 describing a continuously variable valve lift apparatus according to various embodiments of the present invention operated in low lift mode.

Referring to FIG. 1 to FIG. 4, an engine 1 according to various embodiments of the present invention includes a cylinder head 10 and a continuous variable valve lift apparatus mounted to the cylinder head 10.

The continuously variable valve lift apparatus according to various embodiments of the present invention may include a camshaft 30, a cam portion 40 of which two rotation portions 46 are formed thereto, of which a cam 42 is formed between the rotation portions 46 and of which the camshaft 30 is inserted therein, two slider housings 60 of which each rotation portion 46 is rotatably inserted therein, of which a position is moved for changing a relative position of the cam portion 40 with respect to the camshaft 30 and of which a guide slot 64 is formed thereto, a control portion 100 selectively moving the position of the slider housing 30, a guide shaft 66 parallel to the camshaft 30 and inserted into the guide slot 64 for guiding movement of the slider housing 60, an output portion 50 rotatable around a pivot shaft 52 and of which a valve shoe 54 is formed thereto and a valve device 200 configured to be driven by the valve shoe 54.

A mounting bracket 90 is connected to the cylinder head 10 and the pivot shaft 52 is connected to the mounting bracket 90. In the detailed description and claims, the cylinder head 10 is interpreted as including a cam carrier.

The rotation portions 46 and the cam 42 of the cam portion 40 are integrally formed.

Two camshaft holes 32 are formed to the camshaft 30 and a pin hole 72 is formed to each rotation portion 46.

A pin slider 80 and of which a slider hole 82 is formed thereto is rotatably disposed to each pin hole 72 and a connecting pin 32 is connected to each camshaft hole 32 and is slidably inserted into the slider hole 82.

A bearing 62 is interposed between each slider housing 60 and the rotation portion 46. Thus, rotation of the rotation portion 46 may be easily performed. In the drawings, the bearing 62 is depicted as a needle bearing, however it is not limited thereto. On the contrary, various bearings such as a ball bearing, a roller bearing and so on may be applied thereto.

The valve shoe 54 may be formed as a pair and the valve device 200 may be disposed as a pair and each valve device 200 includes a swing arm roller 202 contacting each valve shoe 54 and a valve 204.

An output roller 56 is mounted between the valve shoes 54 and contacting to the cam 42.

The control portion 100 includes an eccentric shaft 102 connected to the slider housing 60. According to operation of a control motor 104 or an actuator, the eccentric shaft 102 is rotated to change a position of the slider housing 60.

The slider housing 60 is connected to a connecting cap 92 and an operation rod 103 eccentrically formed to the eccentric shaft 102 is rotatably disposed between the slider housing 60 and the connecting cap 92.

Figure 5:
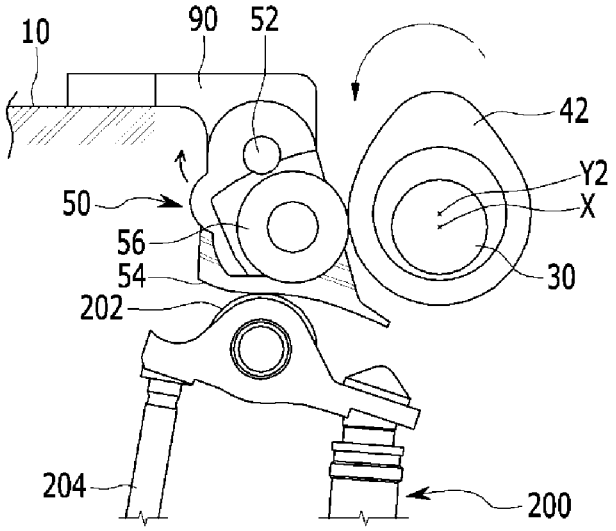
FIG. 5 is a cross-sectional view along line V-V of FIG. 1 describing a continuously variable valve lift apparatus according to an exemplary embodiment of the present invention operated in high lift mode.
Figure 6:
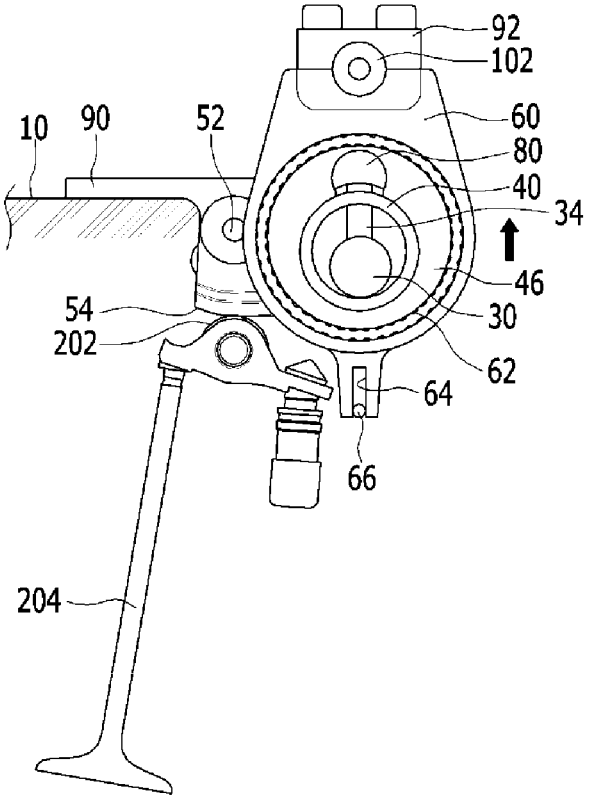
FIG. 6 is a cross-sectional view along line VI-VI of FIG. 1 describing a continuously variable valve lift apparatus according to an exemplary embodiment of the present invention operated in high lift mode.
Figure 7:
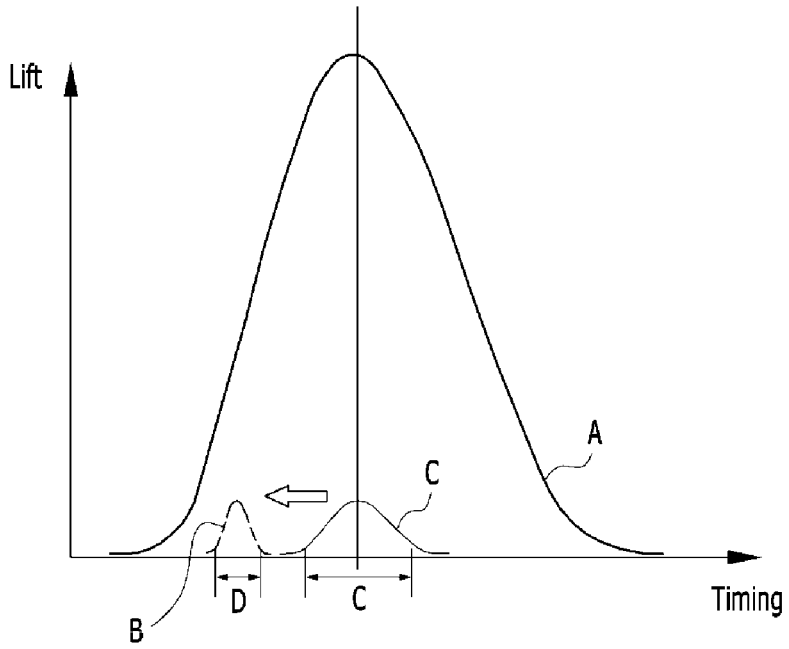
FIG. 7 is a graph of a valve profile of a continuous variable valve lift apparatus according to an exemplary embodiment of the present invention.

FIG. 5 is a cross-sectional view along line V-V of FIG. 1 describing a continuously variable valve lift apparatus according to various embodiments of the present invention operated in high lift mode, FIG. 6 is a cross-sectional view along line VI-VI of FIG. 1 describing a continuously variable valve lift apparatus according to various embodiments of the present invention operated in high lift mode and FIG. 7 is a graph of a valve profile of a continuous variable valve lift apparatus according to an various embodiments of the present invention.

Hereinafter, referring to FIG. 1 to FIG. 7, operations of the continuously variable valve lift apparatus according to various embodiments of the present invention will be described.

When rotation centers of the camshaft 30 and the slider housing 60 are coincident, the valve 204 realizes a predetermined valve lift profile.

According to engine operation states, the ECU transmits control signals to the motor 104 of the control portion 100 to change the relative position of the slider housing 60.

As shown FIG. 3 and in FIG. 4, for example, in low lift mode the slider housing 60 moves to the down direction according to the operation of the control portion 100. Thus, the rotation center of the slider housing 60 with respect to the rotation center X of the camshaft 30 is changed to Y1.

Since the connecting pin 34 is slidable within the cam portion hole 44 and the slider hole 82 and the pin slider 80 is rotatable within the pin hole 72, the rotation of the camshaft 30 is transmitted to the cam portion 40 through the connecting pin 34.

The camshaft 30 rotates around the center X and the cam 42 rotates around the changed rotation center Y1.

Since the relative rotation of the cam 42 is changed, the output portion 50 relatively rotates in a counterclockwise direction around the pivot shaft 52.

Since the output portion 50 relatively rotates in a counterclockwise direction around the pivot shaft 52, a contacting position of the valve shoe 54 and the swing arm roller 202 are changed to the left direction.

As shown in FIG. 5 and FIG. 6, for example, in high lift mode the slider housing 60 moves to the upward direction according to the operation of the control portion 100. Thus, rotation center Y2 of the slider housing 60 relatively moves upward with respect to the rotation center X of the camshaft 30.

Since the connecting pin 34 is slidable within the cam portion hole 44 and the slider hole 82 and the pin slider 80 is rotatable within the pin hole 72, the rotation of the camshaft 30 is transmitted to the cam portion 40 through the connecting pin 34.

The camshaft 30 rotates around the center X and the cam 42 rotates around the changed rotation center Y2.

Since the relative rotation of the cam 42 is changed, the output portion 50 relatively rotates in a clockwise direction around the pivot shaft 52.

Since the output portion 50 relatively rotates in a clockwise direction around the pivot shaft 52, the contacting position of the valve shoe 54 and the swing arm roller 202 are changed to the right direction.

In the various embodiments of the present invention, according to the relative position of the slider housing 60 with respect to the camshaft 30, the rotation center Y1 and Y2 of the cam 42 is changed and thus a contacting position of the output roller 56 and the cam 42 is changed. Thus, when the operation mode of the continuously variable valve lift apparatus is changed to the low lift mode, valve closing timing may be advanced.

Also, since the contacting position of the swing arm roller 202 and the valve shoe 54 is changed, the valve lift is adjusted.

A high lift profile A or a low lift profile B of the valve 204 may be performed according to the relative rotation center of the cam 42 with respect to the camshaft 30, relative positions of the camshaft 30 and the output roller 56 and the contacting position of the valve shoe 54 and the swing arm roller 202.

While only the high lift profile A and the low lift profile B are shown in FIG. 7, however it is not limited thereto. The relative position of the slider housing 60 may perform various valve profiles.

As shown in FIG. 7, comparing to a valve duration C of a general continuously variable valve lift apparatus in the low lift mode, a valve duration D of the continuously variable valve lift apparatus according to various embodiments of the present invention may be reduced.

And valve closing time may be advanced comparing to valve closing time of the general continuously variable valve lift apparatus in the low lift mode due to contacting position change of the cam 42 and the output roller 56.

Figure 8:
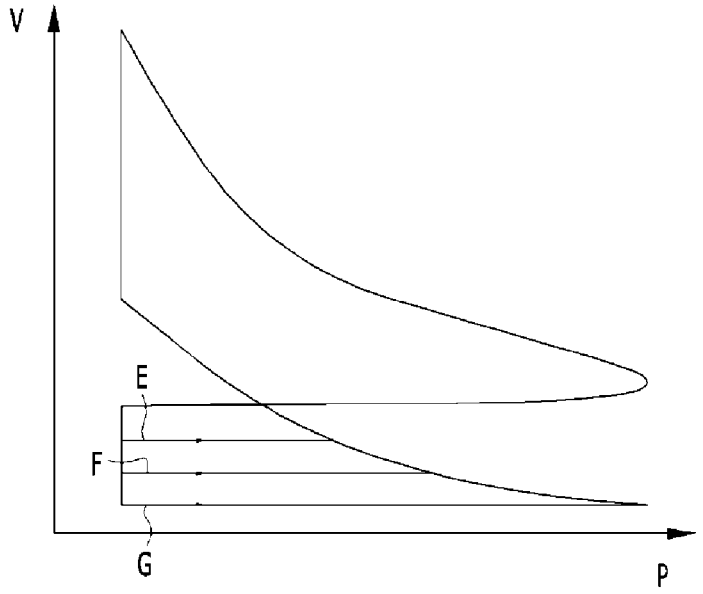
FIG. 8 is a graph of pressure volume diagram of an engine provided with the exemplary continuous variable valve lift apparatus according to the present invention.

FIG. 8 is a graph of pressure volume diagram of an engine provided with the continuous variable valve lift apparatus.

As shown in FIG. 8 an engine provided with a continuous variable valve lift apparatus may reduce pumping loss F comparing to pumping loss E of an engine without a continuous variable valve lift apparatus.

However, the continuously variable valve lift apparatus may reduce valve duration and advance valve closing time so that may reduce pumping loss G and may enhance fuel economy.

The continuous variable valve lift apparatus according to various embodiments of the present invention may be reduced in size and thus the entire height of a valve train may be reduced.

Since the continuous variable valve lift apparatus may be applied to an existing engine without excessive modification, thus productivity may be enhance and production cost may be reduced.

In various embodiments of the present invention, since only one cam and two slider housings are required to control lifts of two valves, structure of the continuous variable valve lift apparatus is simple and stable.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuously variable valve lift apparatus comprising:

a camshaft;

a cam portion including a cam, wherein two rotation portions are formed on the cam portion, wherein the cam is formed between the two rotation portions, and wherein the camshaft is inserted into the cam portion;

two slider housings into which each rotation portion of the two rotation portions is rotatably inserted therein, of which a position is moved for changing a relative position of the cam portion with respect to the camshaft and onto which a guide slot is formed;

a control portion selectively moving the position of each of the two slider housings;

a guide shaft parallel to the camshaft and inserted into the guide slot for guiding movement of the two slider housings;

an output portion rotatable around a pivot shaft and onto which a valve shoe is formed; and a valve device driven by the valve shoe.

2. The continuously variable valve lift apparatus of claim 1, wherein the two rotation portions and the cam of the cam portion are integrally formed.

3. The continuously variable valve lift apparatus of claim 1, wherein:

two camshaft holes are formed on the camshaft; and a pin hole is formed on the each rotation portion of the two rotation portions, wherein the continuously variable valve lift apparatus further comprises:

a pin slider rotatably disposed to each pin hole and onto which a slider hole is formed; and a connecting pin connected to each camshaft hole and slidably inserted into the slider hole.

4. The continuously variable valve lift apparatus of claim 1, further comprising a bearing inserted between each slider housing of the two slider housings and each rotation portion of the two rotation portions.

5. The continuously variable valve lift apparatus of claim 1, wherein:

the valve shoe is formed as a pair of a first valve shoe and a second valve shoe; and the valve device is disposed as a pair and each valve device of the pair comprises a swing arm roller contacting each of the first valve shoe and the second valve shoe.

6. The continuously variable valve lift apparatus of claim 5, further comprising an output roller mounted between the first and second valve shoes and contacting the cam.

7. The continuously variable valve lift apparatus of claim 1, wherein the control portion comprises an eccentric shaft connected to the two slider housings.

8. An engine comprising:

a camshaft;

a cam portion including a cam, wherein two rotation portions are formed on the cam portion, wherein the cam is formed between the two rotation portions, and wherein the camshaft is inserted into the cam portion;

two slider housings into which each rotation portion of the two rotation portions is rotatably inserted, of which a position is moved for changing a relative position of the cam portion with respect to the camshaft and onto which a guide slot is formed;

a control portion selectively moving the position of the two slider housings;

a guide shaft parallel to the camshaft and inserted into the guide slot for guiding movement of the two slider housings;

an output portion mounted to a cylinder head, rotatable around a pivot shaft and onto which a valve shoe is formed; and a valve device driven by the valve shoe.

9. The engine of claim 8, wherein the two rotation portions and the cam of the cam portion are integrally formed.

10. The engine of claim 8, wherein:

two camshaft holes are formed on the camshaft; and a pin hole is formed on the each rotation portion of the two rotation portions, and wherein the continuously variable valve lift apparatus further comprises:

a pin slider rotatably disposed on each pin hole and onto which a slider hole is formed; and a connecting pin connected to each camshaft hole of the two camshaft holes and slidably inserted into the slider hole.

11. The engine of claim 8, further comprising a bearing inserted between each slider housing of the two slider housings and the each rotation portion of the two rotation portions.

12. The engine of claim 8, wherein:

the valve shoe is formed as a pair of a first valve shoe and a second valve shoe; and the valve device is disposed as a pair and each valve device of the pair comprises a swing arm roller contacting each of the first valve shoe and the second valve shoe.

13. The engine of claim 12, further comprising an output roller mounted between the first and second valve shoes and contacting the cam.

14. The engine of claim 8, wherein the control portion comprises an eccentric shaft connected to the two slider housings.

* * * * *